US006557600B1

(12) United States Patent
VeNard

(10) Patent No.: US 6,557,600 B1
(45) Date of Patent: May 6, 2003

(54) HOLD DOWN APPARATUS FOR COMMERCIAL WOOD MOLDER

(75) Inventor: David C. VeNard, Jenison, MI (US)

(73) Assignee: Infinite Reverse Profiling, Jenison, MI (US)

( * ) Notice: Subject to any disclaimer, the term of this patent is extended or adjusted under 35 U.S.C. 154(b) by 0 days.

(21) Appl. No.: 10/067,713

(22) Filed: Feb. 4, 2002

(51) Int. Cl.[7] ..... B27B 31/00

(52) U.S. Cl. ..... 144/250.18; 144/2.1; 144/114.1; 144/134.1; 144/242.1; 144/243; 144/244; 144/250.12; 269/266; 269/25

(58) Field of Search ..... 83/13, 465; 144/2.1, 144/134.1, 114.1, 242.1, 243, 244, 250.12, 250.18; 269/266, 20, 25, 32; 294/88

(56) References Cited

U.S. PATENT DOCUMENTS

| | | | | |
|---|---|---|---|---|
| 176,479 A | | 4/1876 | Patterson | |
| 336,860 A | | 2/1886 | Krum | |
| 485,153 A | | 10/1892 | Creighton | |
| 584,084 A | | 6/1897 | Premo | |
| 636,316 A | | 11/1899 | Brown | |
| 704,147 A | | 7/1902 | Thomas | |
| 954,376 A | | 4/1910 | Buss | |
| 1,042,331 A | | 10/1912 | De Laney | |
| 1,678,835 A | | 7/1928 | Vivarttas | |
| 1,711,342 A | | 4/1929 | Dishman | |
| 1,887,032 A | | 11/1932 | Mann | |
| 2,040,466 A | * | 5/1936 | Christy | 269/266 X |
| 2,399,824 A | | 5/1946 | Pressman | |
| 2,949,674 A | | 8/1960 | Wexler | |
| 3,924,668 A | | 12/1975 | Cromeens | |
| 4,200,272 A | | 4/1980 | Godding | |
| 4,572,564 A | | 2/1986 | Cipolla | |
| 4,691,905 A | | 9/1987 | Tamura et al. | |
| 4,752,063 A | * | 6/1988 | Nagy | 269/266 |
| 4,936,560 A | | 6/1990 | Barozzi | |
| 5,000,237 A | | 3/1991 | Berkeley et al. | |
| 5,011,207 A | | 4/1991 | Stevens | |
| 5,407,185 A | | 4/1995 | Zehnpfennig et al. | |

* cited by examiner

*Primary Examiner*—W. Donald Bray
(74) *Attorney, Agent, or Firm*—Price, Heneveld, Cooper, DeWitt & Litton

(57) ABSTRACT

A hold down apparatus for a commercial molder is provided. The hold down apparatus generally includes a number of hold down plates adapted to hold down a work piece as it is conveyed through the commercial molder. A method of holding down a work piece in a commercial molder is also provided.

36 Claims, 5 Drawing Sheets

HOLD DOWN APPARATUS FOR COMMERCIAL WOOD MOLDER

BACKGROUND OF THE INVENTION

The present invention relates to commercial molders. Specially, the present invention relates to hold down apparatuses for such commercial molders.

Commercial molders are an important part of manufacturing specifically cut materials used in building, in trim work, and to enhance decorative appearances. One part of a commercial molder is a hold down apparatus that holds down the board or other works piece as it is conveyed through the molder. A variety of hold down apparatuses presently exist. However, present hold down apparatuses suffer from complexity and significant construction time. Particularly, the molding process must be stopped each and every time there is a style change to the molding in order to construct a new hold down apparatus to accommodate the new style change. A form fitted hold down apparatus for a commercial molder is desirable because if the hold down apparatus is not form-fitted, the work piece may become unstable, leading to a defect in the cut. Such defects result in increased cost and manufacturing time.

The cost of manufacturing specific materials for their specific needs is very high. As styles and types of materials change, considerable time is needed to design and construct a new and different hold down apparatus for each and every different style and material change in the molding. The construction of such a hold down apparatus typically requires the molder to be shut down while the custom constructed hold down part is installed. Thus, there is a need for a hold down apparatus for commercial molders that does not require the manufacturing process to be shut down while a new hold down apparatus is constructed and installed to specifically fit the different styles and materials used.

SUMMARY OF THE INVENTION

One aspect of the present invention is a hold down apparatus comprising a frame of a rigid material. The frame includes two opposing side walls. A member, having a first and second end, is attached to each of the two opposing side walls. A plurality of hold down plates are present with at least a portion of the hold down plates positioned between the two side walls. Additionally, the hold down plates are adjacent the member extending between the two side walls. The hold down plates are movable in a generally vertical direction and can be moved to a down position due to gravity and positioned so that they are capable of contacting and holding down a molding.

Another aspect of the present invention is a method for holding down a molding. This method includes providing a frame of a rigid material. The frame includes two opposing side walls. A member, having a first and second end, is attached to each of the two opposing side walls. A plurality of hold down plates are present with a portion of the hold down plates positioned between the two side walls. Additionally, the member extending between the two side walls also extends through the hold down plates. The hold down plates are movable in a generally vertical direction and can be moved to a down position due to gravity and positioned so that they are capable of contacting and holding down a molding. The method includes further providing a rigid plate which is adjacent to said hold down plates and movable in a horizontal direction. The rigid plate presses against the hold down plates when pressure is exerted against the hold down plates. The method further includes the steps of raising the hold down plates and holding the plates in an up position by applying pneumatic pressure against the rigid plate; turning off the pneumatic cylinder pressure upon entry of a molding under the hold down plates thereby allowing the hold down plates to fall due to gravity onto the molding; and applying pressure against the rigid plate to move the rigid plate in a horizontal direction, so the rigid plate presses the hold down plates together forcing the hold down plates to hold their shape.

Another aspect of the present invention is a commercial molder having a first frame of a rigid material. The commercial molder also includes cutter devices comprised of one or more cutting heads, the cutter devices being attached to the first frame. The commercial molder further includes a hold down apparatus which is adjacent to the cutter devices. The hold down apparatus includes a second frame of a rigid material comprised of two opposing side walls. The second frame is comprised of at least one member attached to each of the two opposing side walls. A plurality of hold down plates are present with a portion of the hold down plates positioned between the two side walls. Additionally, a member extends between the two sidewalls and is adjacent the hold down plates. The hold down plates are moveable in a generally vertical direction and can be moved to a down position due to gravity and positioned so that they are capable of contacting and holding down a molding.

Another aspect of the present invention is a hold down apparatus for a commercial molder like those described above where the hold down apparatus has hold down plates and a pneumatic cylinder for urging the hold down plates upward to an "up" position.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
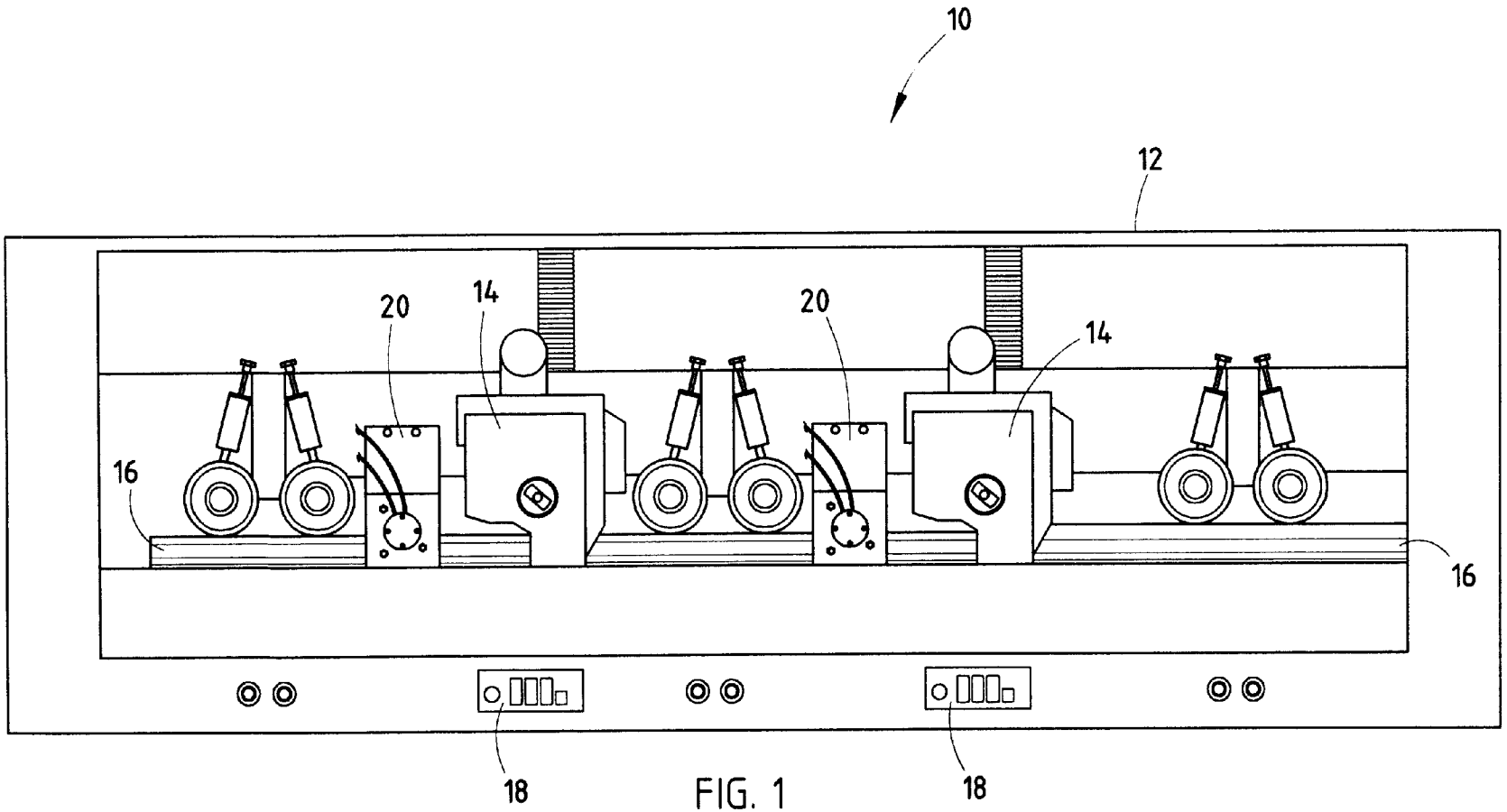
FIG. 1 is an elevational view of a commercial molder of the type that can include the hold down apparatus of the present invention.

Referring now specifically to the drawings and the illustrative embodiments depicted therein, a hold down apparatus 20 embodying the present invention is provided within a commercial molding machine 10 (FIG. 1). In the preferred embodiment, hold down apparatus 20 is designed to be screwed, bolted, welded or otherwise attached to commercial molding machine 10, which is preferably a wood molding machine. Commercial molding machine 10 also includes a rigid frame 12, one or more cutting devices 14 having cutting heads, a conveyor 16, and controls 18. It also includes other parts and features standard in commercial molders.

Figure 5:
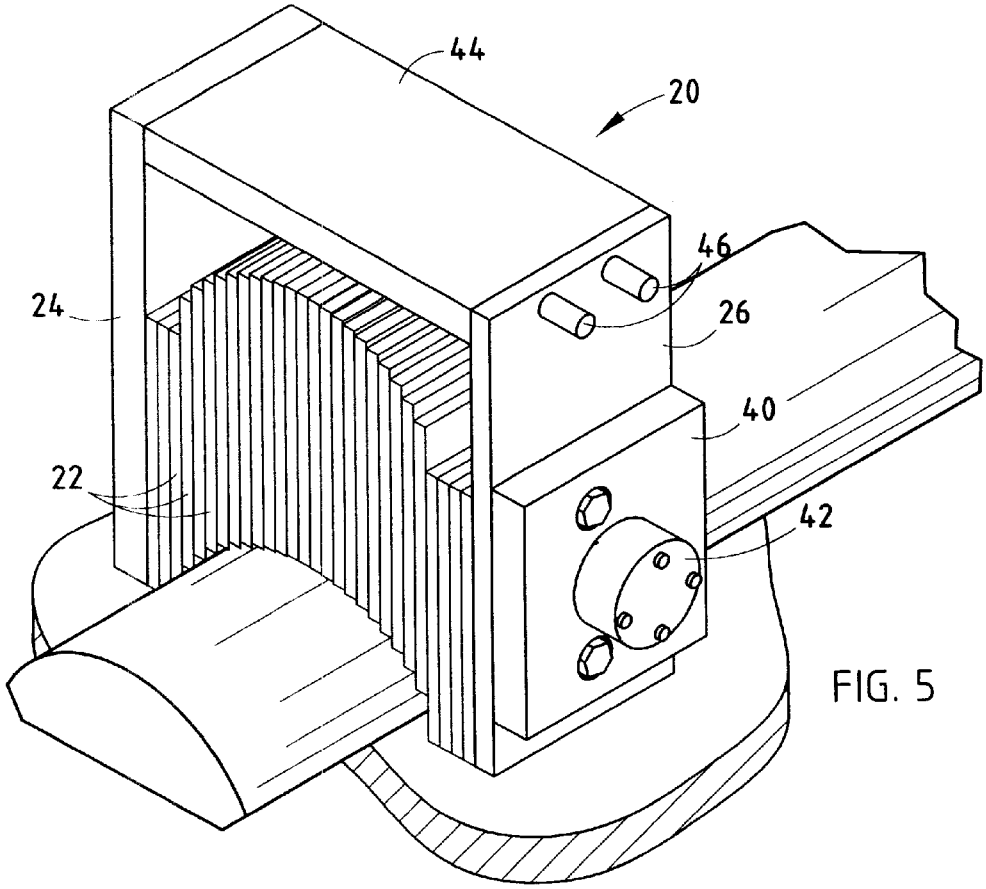
FIG. 5 is a perspective view of the hold down apparatus of the present invention with the plates holding a work piece down.

In the illustrated embodiment (FIG. 5), most parts of hold down apparatus 20 are made from a rigid substance, such as mild steel. Mild steel is particularly adapted to use as a hold down apparatus because it combines an appropriate level of stiffness with strength. Parts described below such as the pneumatic end plate, may also be of other materials such as aluminum.

Figure 2:
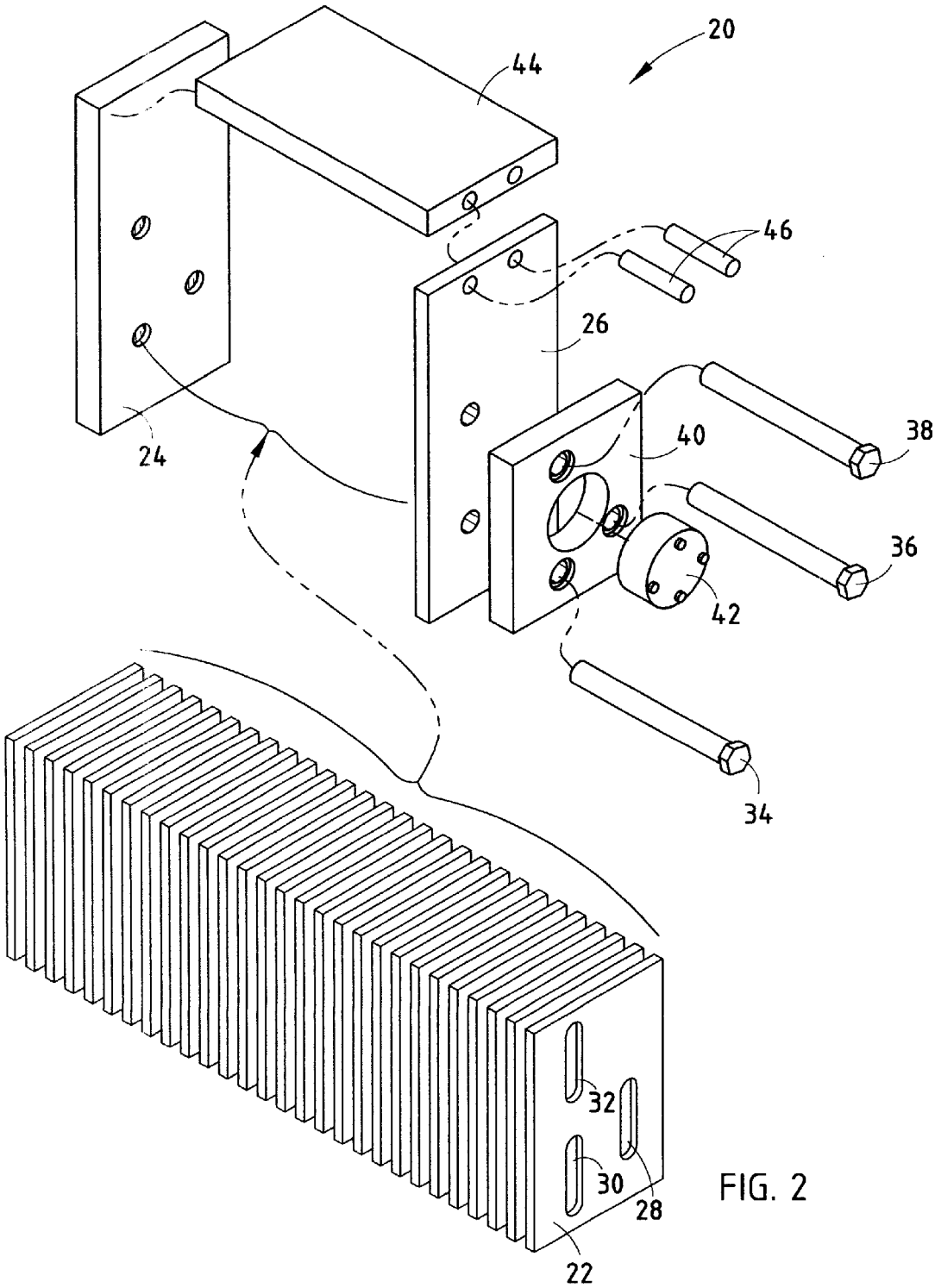
FIG. 2 is an exploded perspective view of the hold down apparatus of the present invention.

Hold down apparatus 20 includes multiple parts. Referring to FIG. 2, a multitude of hold down plates 22 are horizontally juxtaposed to one another and positioned between an end plate 24 and pneumatic end plate 26. Hold down plates 22 are preferably made of ultra-high molecular weight polyethylene and have at least one aperture but preferably three apertures 28, 30, 32 therein. One or more horizontal members 34, 36, 38, which are preferably in the form of a rod, are fixedly connected to end plate 24 and extend through each respective aperture 28, 30, 32 within hold down plates 22, and extend through apertures in pneumatic end plate 26 and connect to pneumatic cylinder housing 40. Pneumatic cylinder housing 40 attaches to a pneumatic cylinder 42 via screws, bolts, welds or other attachment means. Top plate 44 is fixedly attached to end plate 24 and connected to pneumatic end plate 26 via two horizontal pins 46. The attachment between top plate 44 and pneumatic end plate 26 via horizontal pins 46 allows pneumatic end plate 26 to move horizontally. This allows pneumatic end plate 26 to freely move horizontally upon the exertion of pneumatic pressure from pneumatic cylinder 42.

Figure 3:
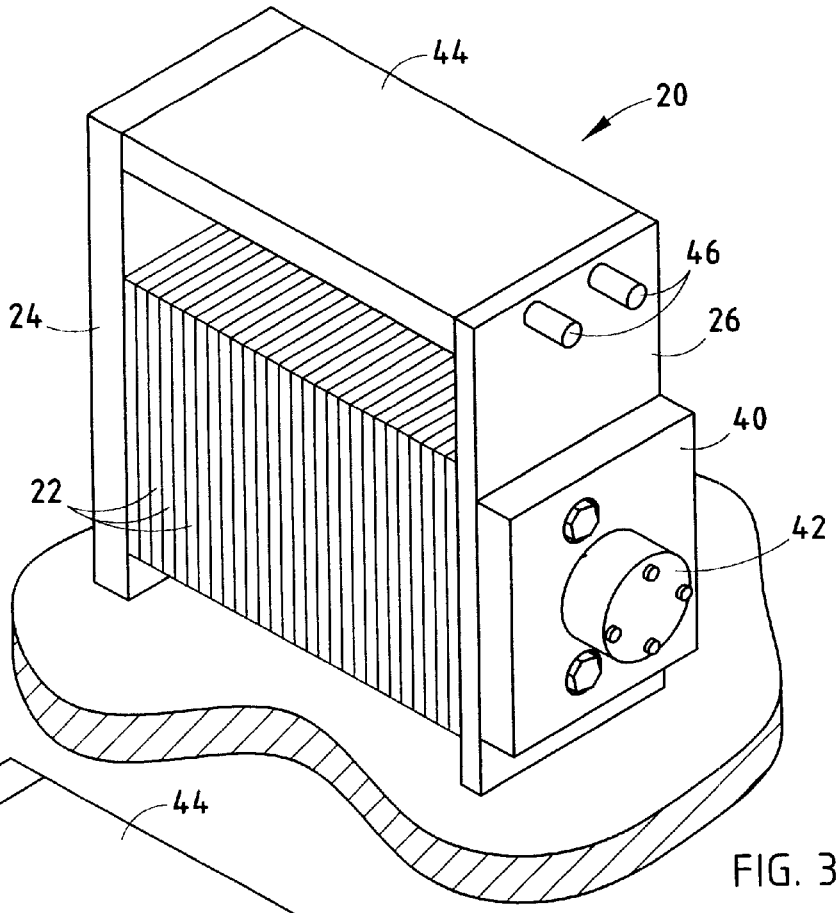
FIG. 3 is a perspective view of the hold down apparatus of the present invention with the plates in the down position.
Figure 4:
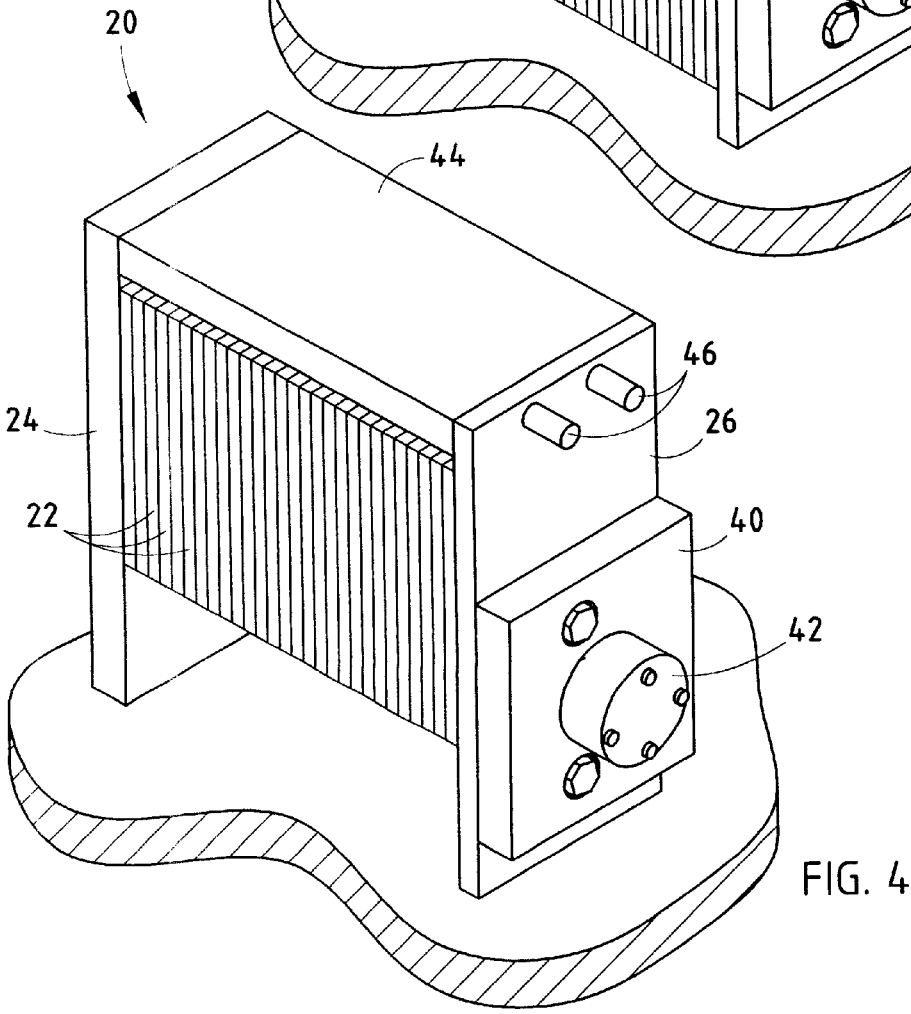
FIG. 4 is a perspective view of the hold down apparatus of the present invention with the plates in the up position.

In operation, generally hold down plates 22 are in a down position (see FIG. 3) when hold down apparatus 20 is at rest. Upon application or use of hold down apparatus 20, hold down plates 22 are moved either mechanically or manually to an up position (see FIG. 4). Pneumatic cylinder 42 is activated, moving pneumatic end plate 26 horizontally against the hold down plates 22, holding them in place. The work piece is then conveyed through the molder 10 and beneath the hold down plates 22. When the pneumatic pressure is released, the force holding hold down plates 22 in the up position no longer exists, and hold down plates 22 fall to the down position due to gravity. Hold down plates 22 generally form a perpendicular relation to the work piece. Upon hold down plates 22 falling onto the work piece, they form the general shape of the piece. Pneumatic cylinder 42 is again activated and exerts pressure against pneumatic end plate 26 thereby moving pneumatic end plate 26 in a generally horizontal direction to exert pressure against hold down plates 22, holding them in the specific outline shape of the molded work piece (see FIG. 5). This process allows a multitude of pieces of molded material to pass through commercial molding machine 10 without unnecessary delays and stoppages. This process also will increase production rates, production output, and decrease or eliminate any previously necessary amounts of time needed to construct new hold down apparatuses for each and every new piece of molded material to pass through a commercial molding machine.

Figure 6:
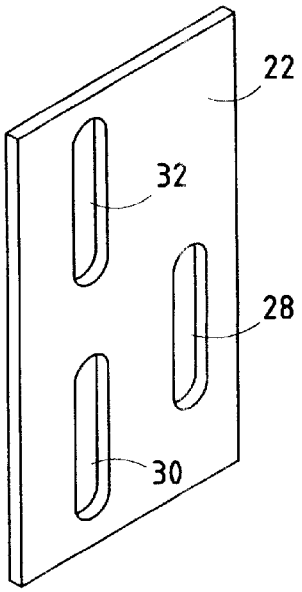
FIG. 6 is a perspective view of one embodiment of a plate having a rectangular shape.
Figure 7:
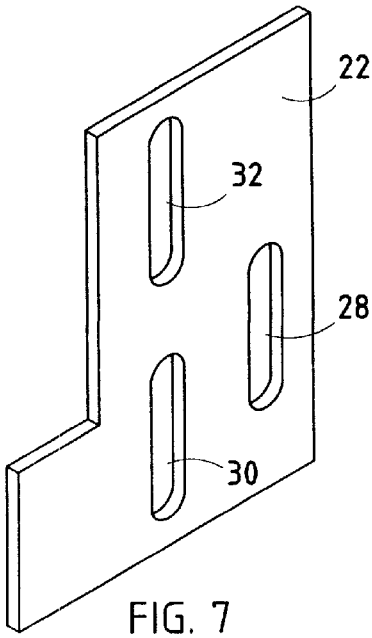
FIG. 7 is a perspective view of a second embodiment of a plate having an "L" shape.
Figure 8:
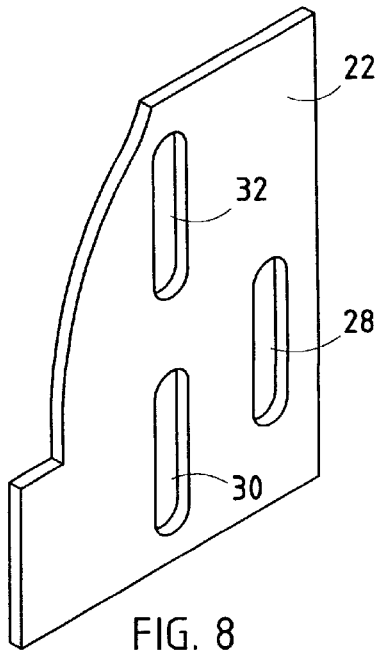
FIG. 8 is a perspective view of a third embodiment of a plate having a custom shape.

Hold down plates 22 (FIGS. 6, 7 and 8) may vary in size and shape depending upon the size and shape of the commercial molding machine 10, hold down apparatus 12 and/or the specific molding material. Hold down plates 22 can be rectangularly shaped with apertures therein (FIG. 6). Alternatively, hold down plates 22 may be "L" shaped (FIG. 7), or can be custom shaped for the particular machine they will be used in (FIG. 8).

Figure 9:
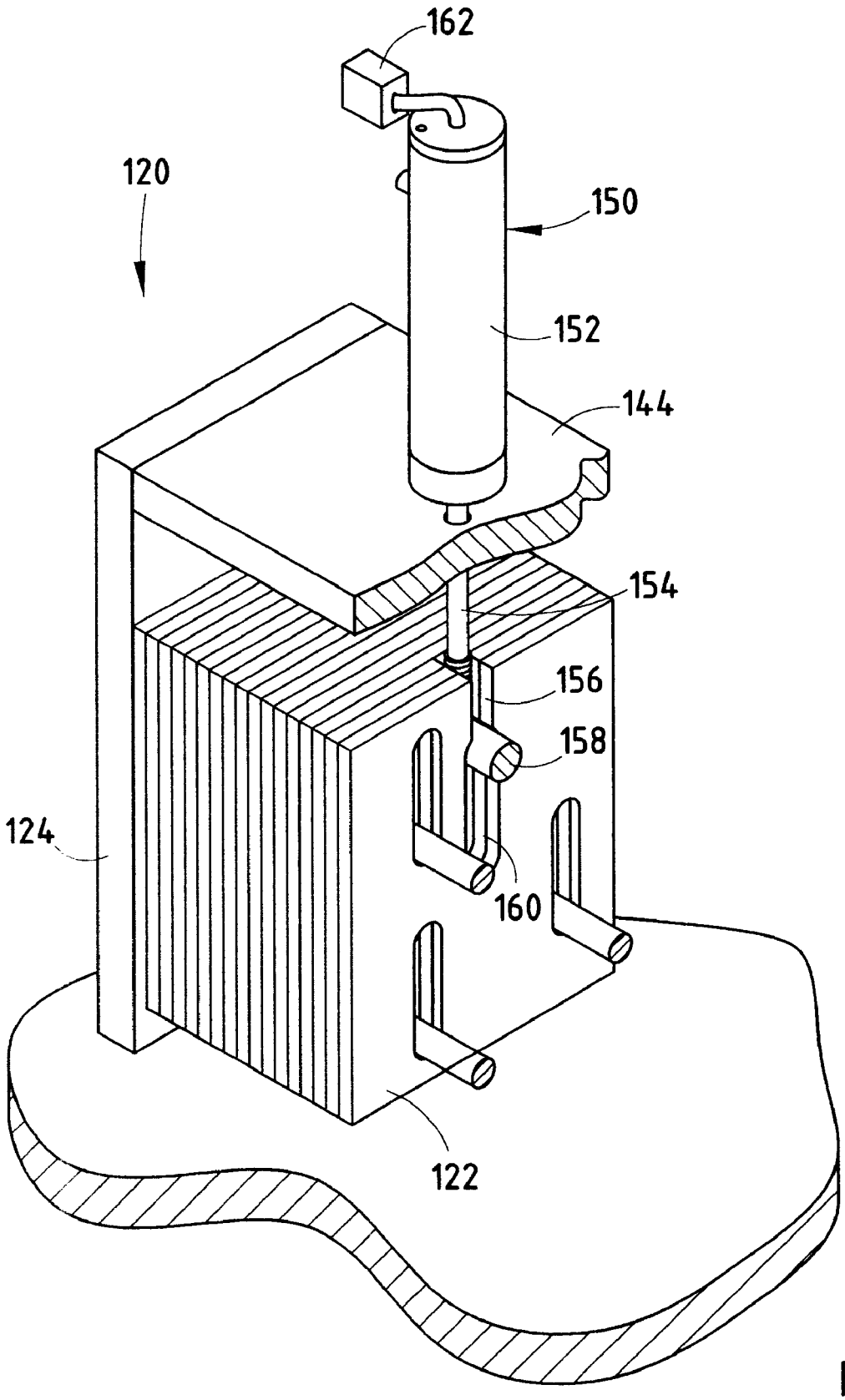
FIG. 9 is a perspective view of a second embodiment of the present invention.

FIG. 9 shows a second embodiment of a hold down apparatus, depicted as 120. Hold down apparatus 120 is the same in many respects to hold down apparatus 20 of the first embodiment and includes hold down plates 122, an end plate 124, a pneumatic end plate (not shown), and a top plate 144. Hold down apparatus 120 further includes a top pneumatic cylinder assembly 150. Pneumatic cylinder assembly 150 includes a top pneumatic cylinder 152, which may be attached to top plate 144 via screws, bolts, welds or other attachment means. Pneumatic cylinder 152 is attached to a vertical rod 154 that extends downwardly from top pneumatic cylinder 152 through an aperture in top plate 144, through slots 156 in one or more of the plates 122, and is attached to a horizontal rod 158. Vertical rod 154 is preferably attached to horizontal rod 158 by threaded engagement, but also could be attached by other attachment means. Horizontal rod 158 extends horizontally through apertures 160 in hold down plates 122. In operation, top pneumatic cylinder 152 is activated and creates an upward force, pulling vertical rod 154 upwardly, which in turn pulls horizontal rod 158 in an upward direction. Horizontal rod 158 engages the plates 122 at the top of apertures 160, pulling the plates upwardly until they reach their "up" position. Upon entry of a molded material under hold down plates 122, top pneumatic cylinder 152 releases thereby allowing hold down plates 122 to fall due to gravity in a vertical direction on top of the underlying work piece. Pneumatic cylinder assembly 150 also preferably includes a pressure valve 162 to regulate the amount of air, and thus the resulting pressure, to pneumatic cylinder 152.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A hold down apparatus for a commercial molder, comprising:

a frame of a rigid material, said frame comprising a first sidewall and a second sidewall, said first and second sidewalls opposing each other;

at least one member having a first end and a second end, said first end attached to said first sidewall and said second end attached to said second sidewall;

a plurality of hold down plates substantially aligned axially with one another relative to the longitudinal axis of said at least one member, at least a portion of which are between said sidewalls and adjacent said at least one member, said hold down plates being movable in a generally vertical direction, and movable to a down position due to gravity, said hold down plates being positioned so that said hold down plates are capable of contacting and holding down a molding.

2. The hold down apparatus defined in claim 1, wherein said hold down plates comprise an organic substance.

3. The hold down apparatus defined in claim 2, wherein said hold down plates comprise ultra-high molecular weight polyethylene.

4. The hold down apparatus defined in claim 3, wherein said hold down plates have an aperture therein, said at least one member passing through said aperture.

5. The hold down apparatus defined in claim 4, wherein said at least one member is a rod.

6. The hold down apparatus defined in claim 4, wherein said at least one member comprises mild steel.

7. The hold down apparatus defined in claim 4, wherein said aperture is elongated.

8. The hold down apparatus defined in claim 1, wherein the longitudinal axis of said hold down plates is substantially perpendicular relative to the longitudinal axis of a work piece being conveyed through the commercial molder.

9. The hold down apparatus defined in claim 1, wherein said hold down plates are in a juxtaposed position relative to one another.

10. The hold down apparatus defined in claim 1, wherein said hold down plates generally comprise an L-shape.

11. The hold down apparatus defined in claim 1, wherein said hold down plates comprise a rectangular shape.

12. A hold down apparatus for a commercial molder, comprising:

a frame of a rigid material, said frame comprising a first sidewall and a second sidewall, said first and second sidewalls opposing each other;

at least one member having a first end and a second end, said first end attached to said first sidewall and said second end attached to said second sidewall;

a plurality of hold down plates substantially aligned axially with one another relative to the longitudinal axis of said at least one member, at least a portion of which are between said sidewalls and adjacent said at least one member, said hold down plates being movable in a generally vertical direction, and movable to a down position due to gravity, said hold down plates being positioned so that said hold down plates are capable of contacting and holding down a molding; and further including a rigid plate adjacent said hold down plates and movable in a substantially horizontal direction to press said hold down plates against each other when pressure is applied against said rigid plate.

13. The hold down apparatus defined in claim 12, wherein said rigid plate comprises mild steel.

14. The hold down apparatus defined in claim 12, wherein said rigid plate comprises aluminum.

15. The hold down apparatus defined in claim 12, and further including a pneumatic cylinder attached to said frame, said pneumatic cylinder adapted to exert pneumatic pressure against said rigid plate.

16. A method for holding down a molding, comprising the steps of:

providing a hold down apparatus comprising:

a frame of a rigid material, said frame comprising a first sidewall and a second sidewall, said first and second sidewalls opposing each other;

at least one member having a first and a second end, said first end attached to said first sidewall and said second end attached to said second sidewall;

a plurality of hold down plates at least a portion of which are between said sidewalls and adjacent said at least one member, said hold down plates being movable in a generally vertical direction wherein said hold down plates are in a down position and said hold down plates are positioned so that said hold down plates is capable of contacting and holding down a molding;

a rigid plate adjacent said hold down plates and movable in a substantially horizontal direction to press said hold down plates against each other when pressure is applied against said rigid plate; and raising said hold down plates to an up position, said hold down plates being held in the up position by applying pressure against said rigid plate;

upon entry of a work piece beneath the hold down plates, releasing the pressure against the rigid plates thereby allowing said hold down plates to fall; and supplying pressure against said rigid plate to move said rigid plate in a substantially horizontal direction to press said hold down plates against each other.

17. The method of claim 16, wherein said hold down plates are of an organic substance.

18. The method of claim 17, wherein said hold down plates comprise ultra high molecular weight polyethylene.

19. The method of claim 18, wherein said hold down plates have an aperture therein, said at least one member passing through said aperture.

20. The method of claim 19, wherein said at least one member comprises a rod.

21. The method of claim 19, wherein said at least one member comprises mild steel.

22. The method of claim 19, wherein said aperture is elongated.

23. The method of claim 16, wherein the longitudinal axis of said hold down plates is substantially perpendicular in relation to the longitudinal axis of a molding being conveyed through the commercial wood molder.

24. The method of claim 16, wherein said hold down plates are in a juxtaposed relative to one another.

25. The method of claim 16, wherein said hold down apparatus further comprises a pneumatic cylinder assembly attached to said frame and adapted to supply pressure against said rigid plate.

26. The method of claim 25, wherein said pneumatic cylinder assembly includes a housing and said at least one member is attached to said pneumatic cylinder assembly housing.

27. The method of claim 16, wherein said rigid plate comprises mild steel.

28. The method of claim 16, wherein said rigid plate comprises aluminum.

29. A commercial molder, comprising:

a first frame of a rigid material;

cutter devices, said cutter devices comprising one or more cutting heads and attached to said first frame; and a hold down apparatus attached to said first frame and adjacent said cutter heads, comprising:

a second frame of a rigid material, said second frame comprising two sidewalls opposing each other;

at least one member, said at least one member attached to each of said sidewalls;

a plurality of hold down plates substantially aligned axially with one another relative to the longitudinal axis of said at least one member, at least a portion of which are between said sidewalls and contacting said at least one member, said hold down plates being movable in a generally vertical direction, wherein said hold down plates are positioned so that said hold down plates are capable of contacting and holding down a molding.

30. The commercial molder defined in claim 29, wherein said hold down plates comprise an organic substance.

31. The commercial molder defined in claim 29, wherein the longitudinal axis of said hold down plates is substantially perpendicular relative to the longitudinal axis of a work piece being conveyed through the commercial molder.

32. The commercial molder defined in claim 29, wherein said hold down plates are in juxtaposed position relative to one another.

33. The commercial molder defined in claim 29, and further including a rigid plate adjacent to said hold down plates and movable in a substantially horizontal direction to press said hold down plates against each other when pressure is applied against said rigid plate.

34. A hold down apparatus for a commercial molder, comprising:

a frame of a rigid material, said frame comprising a first sidewall, a second sidewall, said first and second sidewalls opposing each other;

a plurality of hold down plates, at least a portion of which are between said sidewalls, said hold down plates being movable in a generally vertical direction, and being positioned so that said hold down plates are capable of contacting and holding down a molding; and a pneumatic assembly in engagement with said hold down plates and adapted to raise said hold down plates when pneumatic pressure is applied.

35. The hold down apparatus defined in claim 34, wherein said pneumatic assembly comprises a pneumatic cylinder, a horizontal rod, and a vertical rod;

said hold down plates having apertures therein and said horizontal rod being within said apertures, and wherein said vertical rod is attached to said horizontal rod and said pneumatic cylinder.

36. The hold down apparatus defined in claim 35, wherein said horizontal rod and said vertical rod are attached to one another by a threaded connection.

* * * * *